US007562794B2

(12) United States Patent
Van De Braak et al.

(10) Patent No.: US 7,562,794 B2
(45) Date of Patent: Jul. 21, 2009

(54) PUMP WITH PRESSURE-INDICATION MEANS

(75) Inventors: Bart Lambertus Theodorus Johannes Van De Braak, Weert (NL); Patrick Lambertus Kerkhof, Zoetermeer (NL); Eelco Jan Gerardus Witteveen, Schiedam (NL)

(73) Assignee: Vacu Vin Innovations Ltd., Gibralter (GB)

( * ) Notice: Subject to any disclaimer, the term of this patent is extended or adjusted under 35 U.S.C. 154(b) by 547 days.

(21) Appl. No.: 10/399,491

(22) PCT Filed: Oct. 17, 2001

(86) PCT No.: PCT/NL01/00764

§ 371 (c)(1),
(2), (4) Date: Jun. 1, 2004

(87) PCT Pub. No.: WO02/32766

PCT Pub. Date: Apr. 25, 2002

(65) Prior Publication Data

US 2004/0200863 A1 Oct. 14, 2004

(30) Foreign Application Priority Data

Oct. 17, 2000 (NL) ..... 1016421

(51) Int. Cl.
*B65D 83/00* (2006.01)

(52) U.S. Cl. ..... 222/401; 222/383.1; 222/384; 222/385; 222/341; 417/63; 417/306

(58) Field of Classification Search ..... 222/383.1, 222/401, 384–385, 340–341; 417/305–306, 417/550–551, 63; 137/859
See application file for complete search history.

(56) References Cited

U.S. PATENT DOCUMENTS

| | | | | | |
|---|---|---|---|---|---|
| 1,455,646 | A | * | 5/1923 | Millard | 417/311 |
| 1,471,441 | A | * | 10/1923 | Berg | 417/498 |
| 1,649,530 | A | * | 11/1927 | Holsinger | 137/227 |
| 1,831,379 | A | * | 11/1931 | Creser | 417/63 |
| 3,056,538 | A | * | 10/1962 | Owsen | 417/63 |
| 3,853,222 | A | * | 12/1974 | Helms | 206/315.9 |
| 4,019,629 | A | | 4/1977 | Dubner et al. | |
| 4,120,614 | A | * | 10/1978 | Bouder | 417/63 |
| 4,428,478 | A | * | 1/1984 | Hoffman | 206/315.9 |

(Continued)

FOREIGN PATENT DOCUMENTS

| | | |
|---|---|---|
| EP | 2 717 152 | 9/1995 |
| JP | 3-17186 | 2/1991 |

*Primary Examiner*—Frederick C. Nicolas
(74) *Attorney, Agent, or Firm*—Young & Thompson

(57) ABSTRACT

Pump for applying an increased or reduced pressure to a container. The pump is provided with a plate-like part which reacts to the pressure difference between the container and the environment. This part can preferably adopt two stable positions, and a change is signalled. This change can be brought about, for example, by the sound generated as a result of the plate-like part turning over. The pitch and the like of the sound can be influenced by arranging the plate-like part in a hollow piston and providing the latter with openings leading to the environment.

16 Claims, 4 Drawing Sheets

U.S. PATENT DOCUMENTS 4,518,385 A * 5/1985 Lindmayer et al. ..... 604/68
4,583,925 A * 4/1986 Hawkins ..... 417/555.1
4,763,803 A * 8/1988 Schneider ..... 215/260
4,858,478 A * 8/1989 Kush et al. ..... 73/864.35
4,889,250 A * 12/1989 Beyer ..... 215/228
5,014,848 A * 5/1991 Wild et al. ..... 206/315.9
5,380,175 A * 1/1995 Amarume ..... 417/553
5,533,879 A * 7/1996 Chen ..... 417/553
5,788,463 A * 8/1998 Chan ..... 417/63
6,485,264 B1 * 11/2002 Wu ..... 417/63

* cited by examiner

PUMP WITH PRESSURE-INDICATION MEANS

THE BACKGROUND OF THE INVENTION

The present invention relates to a pump comprising a piston/cylinder assembly which forms part of or is to be fitted to a container, the pressure in said container having to be increased or reduced with respect to the environment by actuation of said piston.

DESCRIPTION OF THE REALTED ART

A pump of this type is known from European Patent Application 234607. This pump is used positioned on a bottle in combination with a rubber stopper. However, it should be understood that the present invention is in no way limited to pumps of this type. By contrast, the invention covers all types of pumps which are used in combination with containers in order to place the contents of the containers under an elevated pressure. Pumps of this type may form a single unit with the lid or cap of containers of this type or may be integrated in or coupled to the lid in some other way.

The pump according to the invention can be used to generate both a reduced pressure and an excess pressure with respect to the environment. This is dependent on the product which is to be stored in the container in question.

Pumps of this type have found widespread use. One drawback for the user is that is difficult to guess whether the excess pressure or reduced pressure which he has applied by pumping is sufficient. Therefore, in practice, operation is often continued until such time as hardly any appreciable work is being performed. However, this time is highly dependent on the quality of the pump, wear to the pump and other factors which cannot be influenced. Moreover, this operation can place an undesirable load on the contents of the container. A more important factor is that for certain products the desired excess pressure or reduced pressure is critical. For example, strawberries have to be stored at an accurately defined reduced pressure. If the reduced pressure is excessive, the strawberries break up. If the reduced pressure is insufficient, premature loss of quality occurs.

SUMMARY OF THE INVENTION

The object of the present invention is to enable the introduction of reduced pressure or excess pressure into a container with the aid of a pump to be metered more accurately.

In the pump described above, this object is achieved in that said piston/cylinder assembly is provided with a plate-like part which can adopt at least two positions as a function of the pressure difference between container and environment, a first position where there is little or no pressure difference and a second position, which is displaced with respect to said first position, when the pressure has been increased or reduced, indicator means being present to provide an indication of a displacement from the first position to the second position or vice versa.

Use of indicator means in the piston/cylinder assembly can provide the user with an indication of when the desired excess pressure or reduced pressure has been reached. These indication means may comprise any structure which is conceivable in the art. Examples are sound indication means, colour indication means, which may optionally act electronically, or other indication means. These are all based on the fact that the plate-like part moves into the second position, which is different from the first position, when the appropriate pressure is reached.

It is preferable to use a plate-like part which includes a stable position. A sound signal can be generated as a result of the part turning over in a design of this type. This sound can be increased by fitting the plate-like part as a closure of a hollow piston. The plate-like part is arranged at the free end of the piston, and the space situated above the plate-like part in the piston or piston rod serves as a sound box. In this case, the quality of the sound can be influenced by fitting specific sound-influencing means, such as one or more openings, in the said sound box. When pumping, the user himself is given an audible or visual feedback of when the desired pressure has been reached.

It is also possible to influence the indication, i.e. to provide adjustment means which can be used either by the producer or the user to adjust the moment at which the indication becomes active, i.e. the structure can react at a higher or lower pressure.

The plate-like part may comprise any material which is conceivable in the art, such as metal and/or plastic. According to a further preferred embodiment of the invention, the plate-like part is produced by injection moulding or by stamping. To enable it to turn over, the part comprises a base part and the actual plate-like part, which passes through the greatest displacement. Between them, there is a transition part. This part may have a reduced thickness or may even be connected as an integral hinge to the corresponding base part or the actual plate part.

As indicated above, the pump can be used both for excess pressure applications and reduced-pressure applications. Typical examples are a turnover point at a reduced pressure of 0.2 bar with respect to the environment and an excess pressure of approximately 1 bar. It should be understood that this is highly dependent on the container used in combination with the pump and the products or foodstuffs stored therein.

Moreover, according to a further embodiment of the invention, it is possible for the user to influence the sound or other indication provided. Instead of the click-clack sound which will be generated by the above-described plate-like part with a stable position, it is also possible, by displacement, to generate a temporary reduced pressure or excess pressure which, with the aid of a gap resulting in a whistling sound signal, can be gradually emitted to the environment.

As indicated above, it is also possible to use a colour change as an indication. Apart from rod systems or other designs which are connected to the plate-like part, it is also possible to use a diaphragm or other plate-like part, which adopts a different colour as a result of stresses in the material under the influence of higher or lower pressure.

According to the present invention, the plate-like part has a stable first position and preferentially moves out of the second position to the first position, i.e. the second position is not stable. Naturally, it is possible for the arrangement to be of bistable design.

BFIEF DESCRIPTION OF THE DRAWINGS

An embodiment of the invention which is currently preferred will be described below with reference to the drawings, in which.

Figure 3:
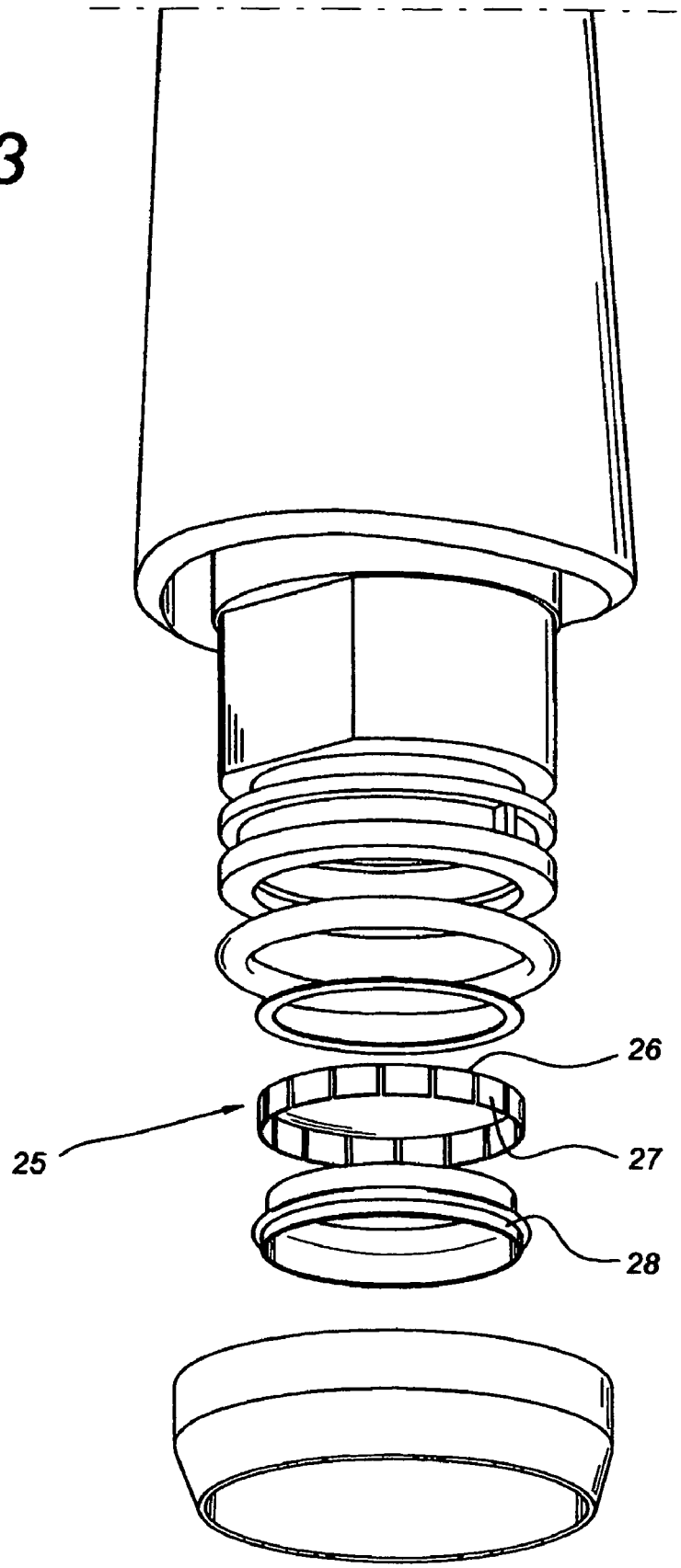
FIG. 3 shows a detail of a variant of the plate-like part.
Figure 4A:
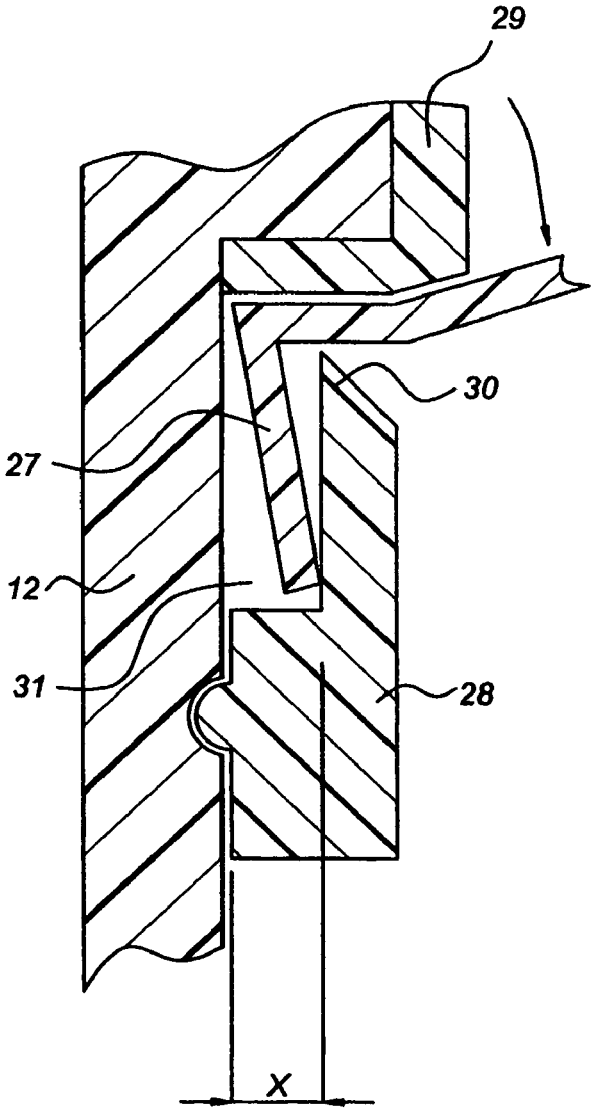

FIG. 4*a, b* show the way in which the plate-like part in FIG. 3 is attached.

DESCRIPTION OF THE PREFERRED EMBODIMENTS

Figure 1:
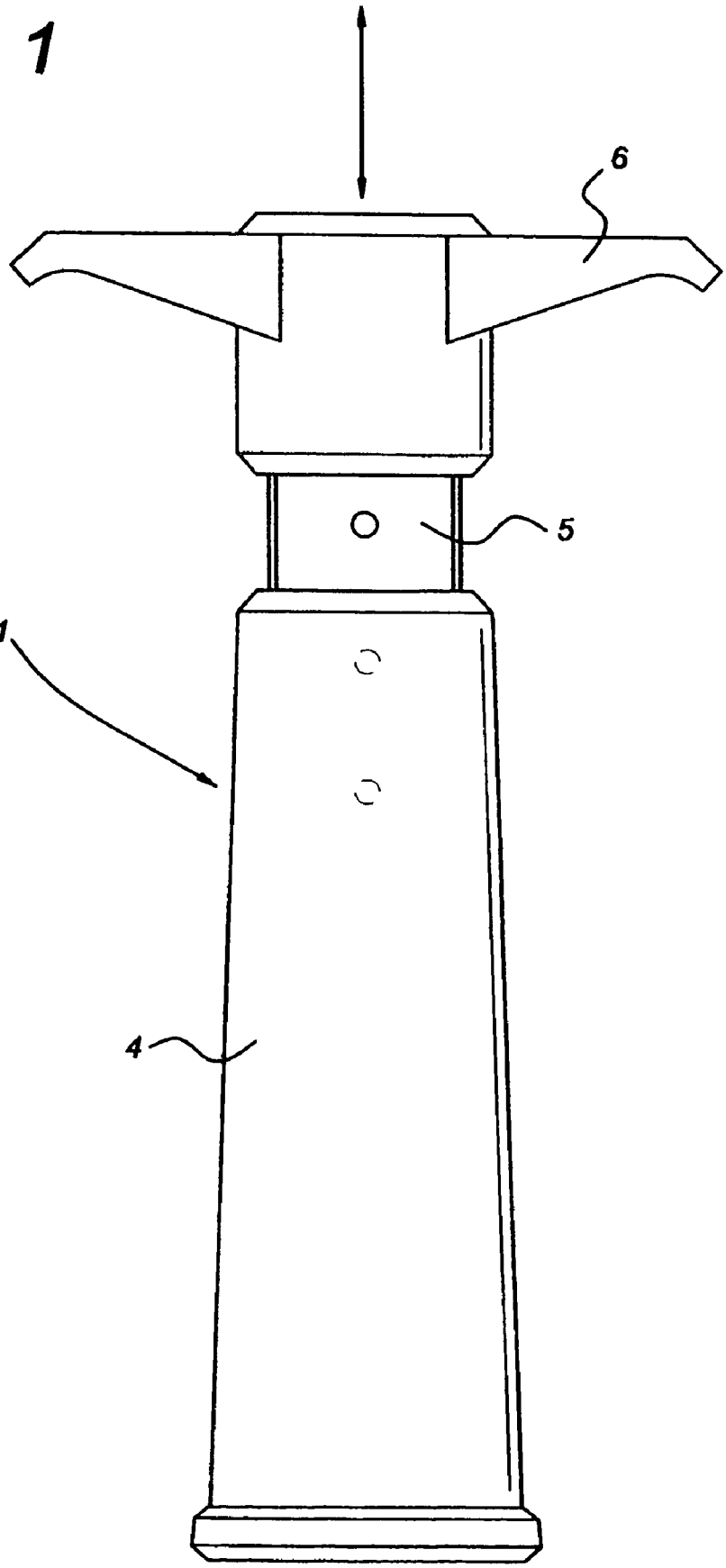
FIG. 1 shows a front view of a pump according to the invention.
Figure 2:
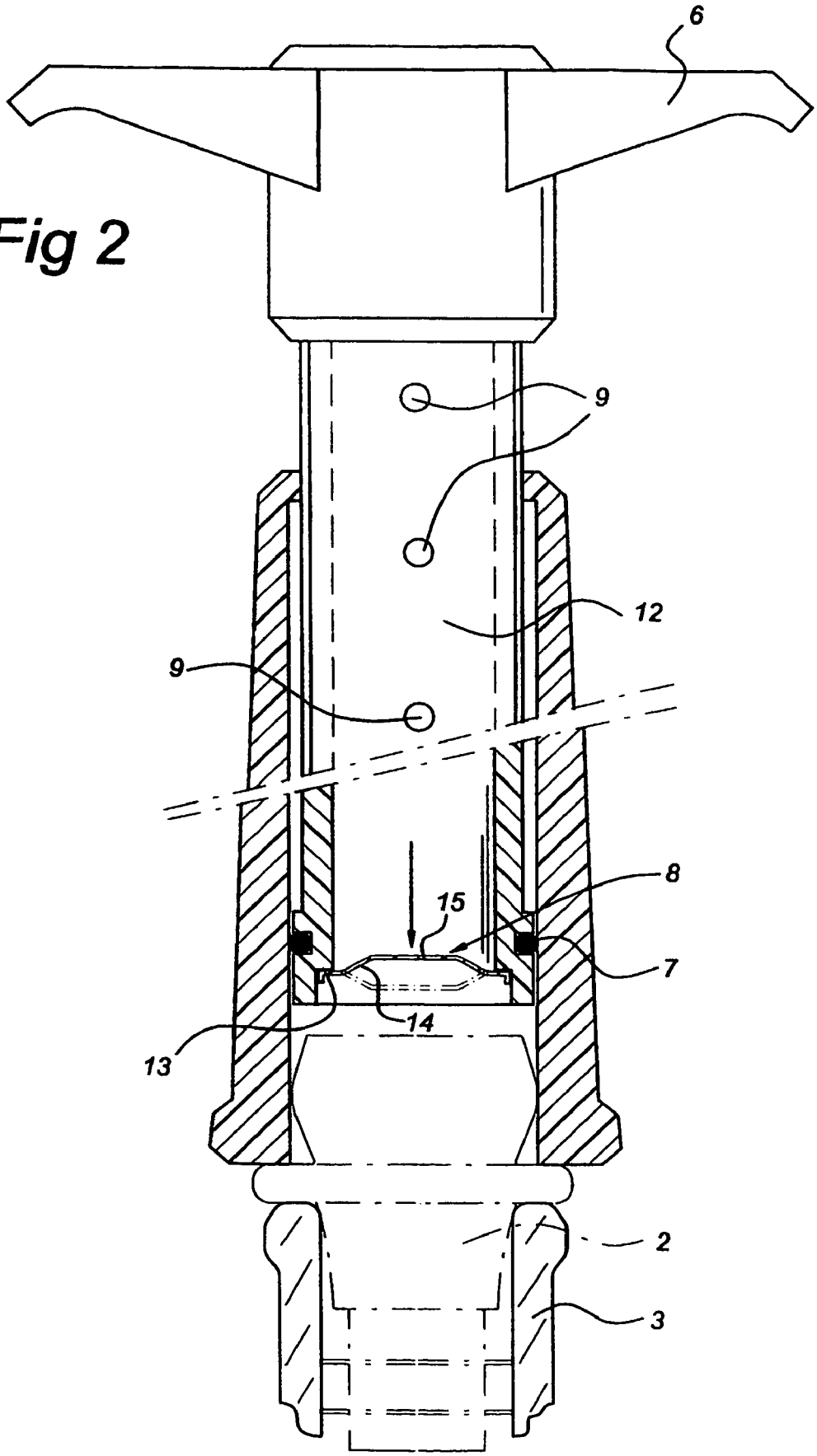
FIG. 2 shows the pump illustrated in FIG. 1 in cross section and fitted to a container.

In the figures, 1 denotes a vacuum pump. As has already been indicated above, the invention can be used equally well for an over pressure pump. This vacuum pump 1 is to be used in combination with a plug, which is illustrated by dashed lines 2 in FIG. 2, since it does not form part of the invention. The same applies to the neck of the bottle 3. In this case too, other designs are possible. Pump 1 comprises a cylinder part 4 and a piston part 5 which moves inside it. Piston part 5 is actuated with a handle 6. Piston part 5 comprises a hollow piston stem 12 which is closed off at one end by a closure plate 8. Piston part 5 is likewise provided with an O-ring seal 7. Closure plate 8 is made from metal by stamping and comprises a base part 13, transition part 14 and the actual plate-like part 15, which reacts to pressure. Naturally, the plate-like part may also be composed in some other way of one or more materials.

Moreover, there are one or more openings 9 in the hollow piston stem 12. The closure plate 8 has a stable position. The first stable position is shown by continuous lines; in this position, there is no pressure difference on either side of the plate. Dashed lines show the second position, in which at least the desired pressure difference in bottle 3 with respect to the environment has been reached. Movement into this second position out of the first position takes place suddenly, with the result that a click-clack sound is generated. This is amplified further in the hollow stem 12, and the sound is influenced by the position and location of the openings 9.

It will be understood that after the pump 1 has been fitted to a container and handle 6 has been actuated, closure plate 8 turns when the desired pressure is reached, with the result that the desired sound is generated and the user is provided with an indication that the appropriate excess or reduced pressure has been reached.

As well as a sudden transition from the first position to the second position, a gradual transition is also possible.

Figure 4B:
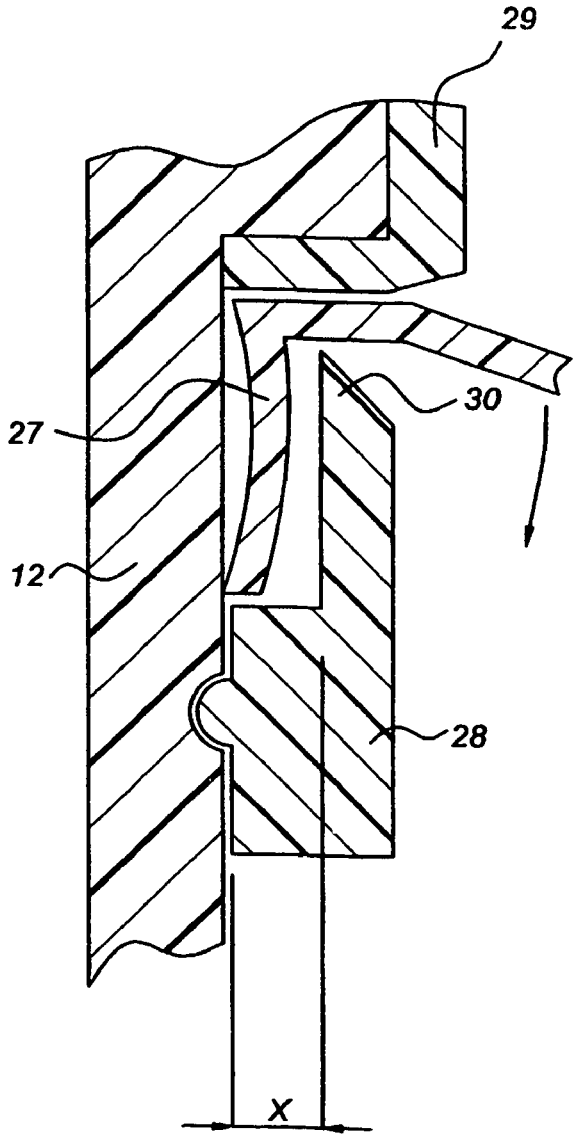

FIG. 3 shows a detail of a further plate-like part, which is denoted overall by 25. It comprises a base body 26 and a number of flanged lips 27 extending there from. This is clamped in the desired position with ring 28. This is shown in more detail in FIGS. 4*a* and *b*. It can be seen from these figures that the top side of ring 28 is provided with a part 30 which tapers to a point and presses the plate-like part onto a rubber ring 29. A chamber 31, inside which the flanged lips 27 can move, is delimited between ring 28 and the outer side of the hollow piston stem 12. The stable position is shown in FIG. 4*a*. Starting from this position, as a vacuum is applied, a plate-like part 25 will easily be able to turn as a result of the space which is present, with the pivot point being the attachment point at 30. This is shown in FIG. 4*b*.

The material used for the plate-like part 15, 25 may be any material which is known in the prior art, such as for example stainless spring steel. The thickness is dependent on the surface area, the desired pitch and the like. In one exemplary embodiment, the thickness is approximately 0.1 mm. It is important for the plate-like part to be designed in such a manner that elastic deformation is readily possible and, moreover, the return movement is ensured when the pressure difference disappears.

Although the invention has been described above with reference to a preferred embodiment, it should be understood that numerous modifications may be made to this embodiment without departing from the scope of the present application as described in the appended claims.

The invention claimed is:

1. A pump, comprising:

a piston/cylinder assembly that can be connected to a container so that a pressure in said container is reduced with respect to a pressure outside of said container by actuation of a piston in said piston/cylinder assembly, said piston/cylinder assembly being provided with a plate-like part, arranged in the piston, which adopts at least two positions as a function of a pressure difference between an inside of said container and said outside of said container, a sealing part provided on an outer surface of said piston and providing a sealing between said piston and said cylinder, said sealing part being separate from said plate-like part, said plate-like part not sealing said piston and said cylinder, the at least two positions including a first position wherein there is little or no said pressure difference, and a second position, which is displaced with respect to the first position, wherein the pressure difference has been increased or reduced, said plate-like part configured to generate an audible indication of the displacement from the first position to the second position or vice versa.

2. The pump according to claim 1, in which said plate-like part flexes between i) a stable position with respect to an end of said piston, and ii) a displaced position with respect to the end of said piston, the flexing being responsive to a change in the pressure difference between the inside of said container and the outside of said container.

3. The pump according to claim 1, in which said piston/cylinder assembly is provided with sound-tuning means.

4. The pump according to claim 3, in which said sound-tuning means comprise at least one opening to the exterior from the interior of said piston/cylinder assembly.

5. The pump according to claim 1, in which said plate-like part is provided with adjustment means.

6. The pump according to claim 1, in which said plate-like part is an injectionmoulded plate.

7. A pump, comprising:

a piston/cylinder assembly that can be connected to a container so that, by actuation of a piston in said piston/cylinder assembly, a pressure in said container is reduced with respect to a pressure outside of said container, a sealing part provided on an outer surface of said piston and providing a sealing between said piston and said cylinder so that movement of the piston in a first direction develops a pressure difference between an inside of said container and said outside of said container, said sealing part being separate from said plate-like part, said plate-like part not sealing the piston and said cylinder, said piston/cylinder assembly being provided with a plate-like part which flexes between at least two positions as a function of the pressure difference developed between the inside of said container and said outside of said container, a first position where there is little or no said pressure difference, and a second position, which is displaced with respect to the first position, when the pressure difference has been increased or reduced, said flexing of said plate-like part between said first position and said second position being a sound-generator means to provide an indication of displacement from the first position to the second position or vice versa.

8. The pump according to claim 7, in which said plate-like part includes a stable position.

9. The pump according to claim 7, in which said plate-like part is arranged at an end cross-section part of the piston and flexes in said first direction with respect to a reference location on a wall portion of said piston.

10. The pump according to claim 7, in which said piston/cylinder assembly is provided with sound-tuning means.

11. The pump according to claim 10, in which said sound-tuning means comprise at least one opening to the exterior from the interior of said piston/cylinder assembly.

12. The pump according to claim 7, in which said plate-like part is provided with adjustment means.

13. The pump according to claim 7, in which said plate-like part is an injection-moulded plate.

14. The pump according to claim 7, in which said piston/cylinder assembly is provided with sound-tuning means comprising on opening within a wall part of the piston.

15. A pump comprising:

a piston part (5) having a hollow piston stem (12), the piston stem displaceable in a first direction;

a hollow cylinder (4) containing said piston part and having an end portion configured to connect to a container so that a pressure inside the container is reduced with respect to a pressure outside the container by operation of said piston within said cylinder, a first end of said piston part extending outside said cylinder, a second end of said piston part remaining within the cylinder during the operation of said piston;

a displaceable plate part (15) at the second end of said piston stem, said displacement plate part having i) a resting position with respect to the second end of said piston stem and ii) at least one other position with respect to the resting position and with respect to the second end of said piston stem; and an indicator (9) that indicates the position of said displacement plate part during the operation of said piston, the indicator acting responsive to movement of said displacement plate part from the resting position to the at least one other position, wherein said displacement plate part is configured for the movement from the resting position to the at least one other position in reaction to a pressure difference created between the pressure inside said container and the pressure outside said container, the movement from the resting position to the at least one other position being indicated via the indicator, wherein said the audible indicator comprises plural openings from an interior of said piston stem to an exterior of said piston stem.

16. A pump, comprising:

a piston part (5) having a hollow piston stem (12), the piston stem displaceable in a first direction;

a hollow cylinder (4) containing said piston part and having an end portion configured to connect to a container so that a pressure inside the container is reduced with respect to a pressure outside the container by operation of said piston within said cylinder, a first end of said piston part extending outside said cylinder, a second end of said piston part remaining within the cylinder during the operation of said piston;

a displaceable plate part (15) at the second end of said piston stem, said displacement plate part having i) a resting position with respect to the second end of said piston stem and ii) at least one other position with respect to the resting position and with respect to the second end of said piston stem;

an indicator (9) that indicates the position of said displacement plate part during the operation of said piston, the indicator acting responsive to movement of said displacement plate part from the resting position to the at least one other position, wherein said displacement plate part is configured for the movement from the resting position to the at least one other position in reaction to a pressure difference created between the pressure inside said container and the pressure outside said container, the movement from the resting position to the at least one other position being indicated via the indicator; and a sealing part provided on an outer surface of said piston stem and providing a sealing between said piston stem and said cylinder so that movement of the piston stem in the first direction develops the pressure difference between an inside of said container and said outside of said container, said sealing part being separate from said displaceable plate part, said displaceable plate part not sealing said piston stem and said cylinder, wherein, the displaceable plate part (15) has the least one other position displaced in the first direction with respect to the resting position and with respect to the second end of said piston stem, and the indicator acts responsive to movement of said displacement plate part from the resting position to the at least one other position with said displacement plate part configured for the movement in the first direction from the resting position to the at least one other position in reaction to the pressure difference created between the pressure inside said container and the pressure outside said container, the first direction movement from the resting position to the at least one other position being indicated via the indicator.

* * * * *